US009010005B2

(12) United States Patent
Faifer

(10) Patent No.: US 9,010,005 B2
(45) Date of Patent: Apr. 21, 2015

(54) AMMUNITION MAGAZINE

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 13/921,229

(22) Filed: Jun. 19, 2013

(65) Prior Publication Data

US 2014/0373415 A1 Dec. 25, 2014

(51) Int. Cl.
*F41A 9/65* (2006.01)

(52) U.S. Cl.
CPC ..... *F41A 9/65* (2013.01)

(58) Field of Classification Search
CPC ..... F41A 9/65
USPC ..... 42/49.01, 50, 49.02, 7, 87, 6; 124/45, 124/52; 89/33.1
See application file for complete search history.

(56) References Cited

U.S. PATENT DOCUMENTS

| | | | | |
|---|---|---|---|---|
| 1,307,492 | A * | 6/1919 | Hammond | 42/7 |
| 4,430,821 | A * | 2/1984 | Vincent | 42/50 |
| 5,291,679 | A * | 3/1994 | Wollack et al. | 42/50 |
| 7,200,964 | B2 * | 4/2007 | Gates | 42/50 |
| 2012/0030987 | A1 * | 2/2012 | Lee, III | 42/87 |

* cited by examiner

*Primary Examiner* — Reginald Tillman, Jr.
(74) *Attorney, Agent, or Firm* — Deborah Gador

(57) ABSTRACT

An ammunition magazine including a housing having a base, a follower spring-biased in the housing against the base, a chain coupled to the follower for pulling the follower towards the base to permit loading of cartridges into the magazine, and a mechanism for collecting a loose portion of the chain mounted on the follower, the chain being coupled to the mechanism for collecting a loose portion of the chain, the mechanism being configured to collect a loose portion of the chain after the follower has been pulled towards the base.

12 Claims, 5 Drawing Sheets

AMMUNITION MAGAZINE

FIELD OF THE INVENTION

The present invention relates to ammunition magazines, in general, and, in particular, to devices for aiding in loading and unloading cartridges in ammunition magazines.

BACKGROUND OF THE INVENTION

Manual loading and unloading of cartridges in ammunition magazines in general, and in rifle magazines in particular, is time consuming and painful for the fingers. In addition, over time, the conventional loading method causes deformation of the lips of the magazine which, in turn, can cause problems feeding cartridges from the magazine into the chamber of the firearm.

There are known magazines with pull cords attached to the follower, which are used to help load the magazine. When these magazines are loaded with one or more cartridges, the user pulls the follower towards the base of the magazine by pulling the pull cord. The result is that the cord hangs beyond the base of the magazine or becomes tangled inside the magazine spring.

Accordingly, there is a long felt need for a simple device for pulling the follower to aid in loading and unloading an ammunition magazine, and it would be very desirable if the device did not leave a pull cord dangling from the magazine when the magazine was full or partially full.

SUMMARY OF THE INVENTION

The present invention relates to an ammunition magazine having a mechanism for aiding loading and unloading cartridges that is an integral part of the magazine, substantially without affecting its size or function. The mechanism includes a chain or cord or belt to pull the follower of the magazine towards the base of the magazine, and includes a spring biased pulley or retracting reel mechanism disposed inside the magazine to automatically retract any loose pulled chain into the magazine and collect it about the pulley or reel, so it does not tangle in the magazine spring or dangle from the base of the magazine when the firearm is ready for firing. The chain inside the walls of the magazine is kept taut, with no loose chain free in the housing. This prevents any excess chain from interfering with a user of the firearm.

There is thus provided according to the present invention: an ammunition magazine including a housing having a base, a follower inside the housing spring-biased against the base, a chain coupled at one end to the follower for pulling the follower towards the base. The chain may be attached at another end to a pull element outside the base of the magazine for pulling the chain. Pulling the pull element pulls the follower towards the base of the magazine, towards is loaded orientation, and compresses the magazine spring to permit unencumbered loading or unloading of cartridges into or from the magazine. Typically, the chain is threaded through an aperture in the base. The magazine further includes a mechanism mounted on the follower, to which the chain is coupled, for collecting a loose portion of the chain when the follower is pulled towards the base. Pulling the pull element also extends and loads the spring in the chain collecting mechanism, so that releasing the pull element releases the spring, causing the reel to rotate or the spring to retract and wind the chain around the reel.

In some embodiments, a locking mechanism is provided so the follower can be releasably locked in the filling orientation. Alternatively, the reel or the chain can be locked in the filling orientation.

There is also provided, according to the invention, a retrofit kit for conventional ammunition magazine having a housing with a base and a follower in said housing spring-biased against the base, the kit including a replacement follower, a replacement base for the magazine, a chain coupled to the follower (and, optionally, to a pull element) for pulling the follower towards the base, and a mechanism, mounted on the follower and coupled to the chain mechanism, configured to collect a loose portion of the chain after the follower has been pulled towards the base.

According to one embodiment, the mechanism includes a mainspring coupled to a pulley, or a retracting reel mechanism, coupled to the follower for winding the loose chain around the pulley.

According to alternative embodiments of the invention, the chain is not coupled to a reel mechanism, but rather is coupled directly to the spring. The spring, in turn, is not mounted on a reel but mounted about a fixed pin mounted on the follower.

There is further provided according to the invention, a method for forming an ammunition magazine, the method including providing a housing having a base, spring-biasing a follower against the base in the housing; coupling a chain to the follower for pulling the follower towards the base; mounting on the follower a mechanism configured to collect a loose portion of the chain after the follower has been pulled towards the base; and coupling the chain to the mechanism for collecting.

According to some embodiments, the step of collecting includes winding the chain around a spring-biased pulley or retracting reel mechanism mounted on the follower.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to ammunition magazines incorporating a mechanism for aiding in loading and unloading cartridges into and from the magazine. The mechanism includes a chain connected to the spring-loaded follower in the magazine. As in conventional magazines with pull cords, pulling the chain pulls the spring-biased follower towards the base of the magazine against the action of the magazine spring. This makes space available in the magazine for loading or unloading cartridges. Release of the chain permits the magazine spring to urge the follower and any cartridges in the magazine towards the lips of the magazine.

Figure 1:
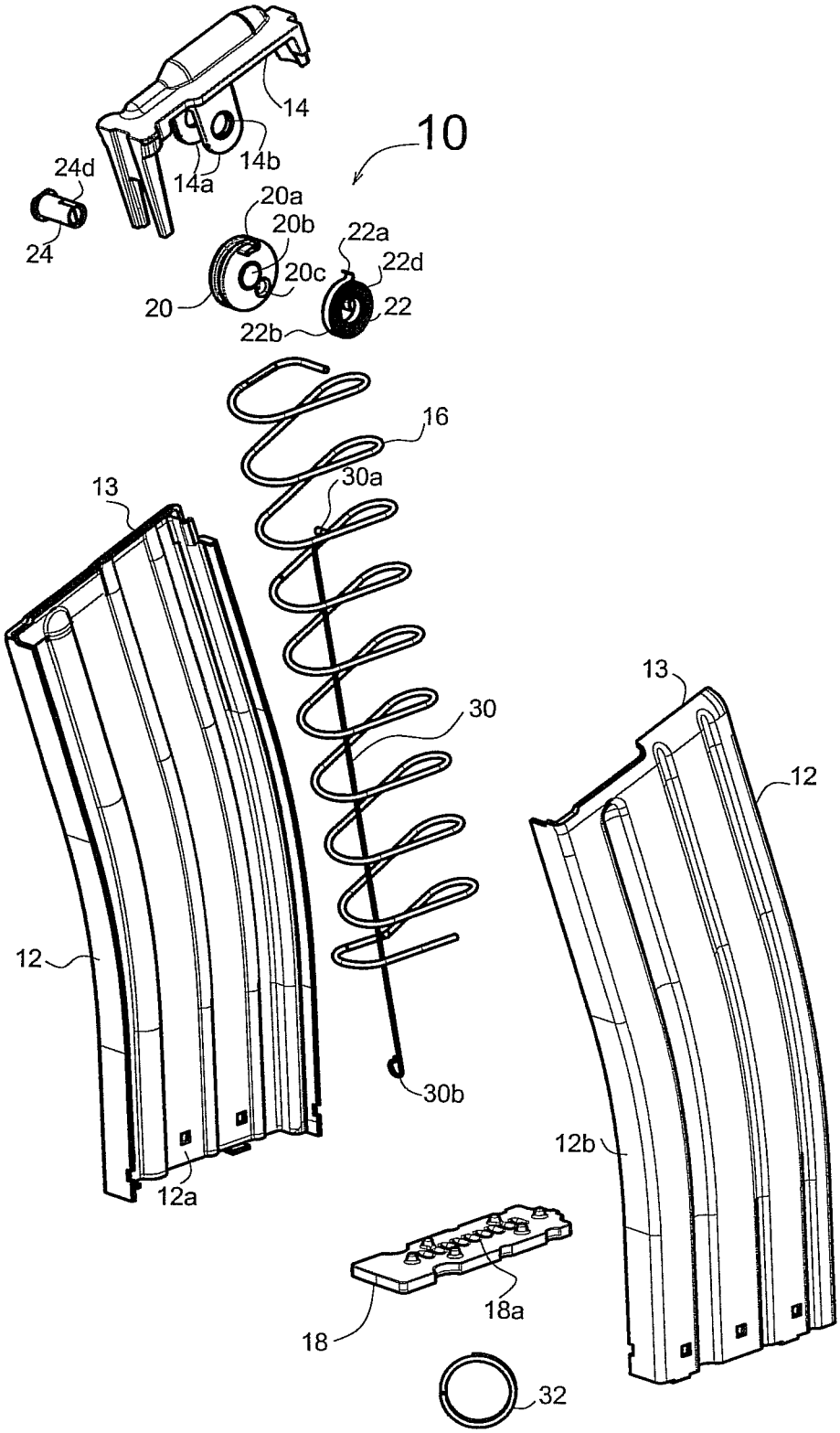
FIG. 1 is an exploded illustration of an ammunition magazine, constructed and operative in accordance with one embodiment of the present invention, for a rifle, particularly a M16 or AR15 rifle.
Figure 2:
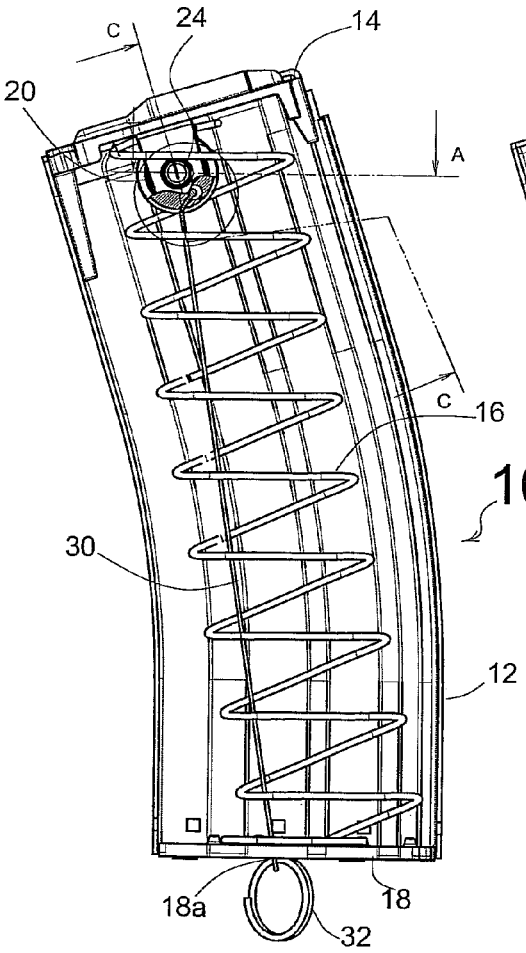
FIG. 2 is a cutaway illustration of the magazine of FIG. 1 in a substantially empty, pre-loading orientation.

The mechanism of the present invention also includes a device for collecting the length of chain that has been pulled from the magazine. When a quantity of chain extends outside the magazine, the mechanism collects the loose chain inside the magazine in a neatly organized manner. One exemplary mechanism is a retracting reel mechanism, or spring biased pulley, preferably biased by a mainspring or a coiled tension spring. The mainspring is affixed between the axle of the reel and the reel itself. The chain is affixed to the reel. When the chain is pulled, the pulley rotates, which extends the mainspring. When the chain is released, the spring retracts, rotating the pulley and collecting the chain from outside the magazine by wrapping it around the pulley. Alternatively, one end of a mainspring can be attached to the follower and the chain can be affixed directly to the other end of the mainspring. In this case, pulling the chain extends the spring and release of the chain causes the spring to contract and collect the chain around it FIG. 1 is an exploded illustration and FIG. 2 is a cutaway side view of an ammunition magazine 10, constructed and operative in accordance with one embodiment of the present invention, particularly suited for use with an M16, AR15 or any other rifle that is fed by a removable, refillable magazine. Magazine 10 is substantially a conventional magazine, including a housing 12 and a follower 14 for engaging and supporting a plurality of cartridges inside housing 12. Housing 12 has two halves 12*a* and 12*b*, each with a protruding magazine lip 13 for restraining loaded cartridges. Magazine 10 further includes a base 18. Base 18 has at least one aperture 18*a* formed through it. Follower 14 is biased by a magazine spring 16 seated on base 18 of housing 12 to urge the cartridges in the magazine towards the magazine lips 13. A chain 30 for assisting in the loading and unloading of the magazine is affixed to follower 14 and extends through aperture 18*a*.

The magazine 10 of the present invention differs from conventional magazines in that the follower 14 supports a mechanism for collecting the chain after the follower has been pulled towards the base in the magazine. According to the exemplary embodiment illustrated herein, the chain collecting mechanism includes a retracting reel mechanism 20 disposed for rotation about an axle 24. Axle 24 is fixedly mounted between two depending lugs 14*a* affixed to follower 14. Each of depending lugs 14*a* defines an aperture 14*b* therethrough to which the ends of axle 24 are affixed.

Figure 6:
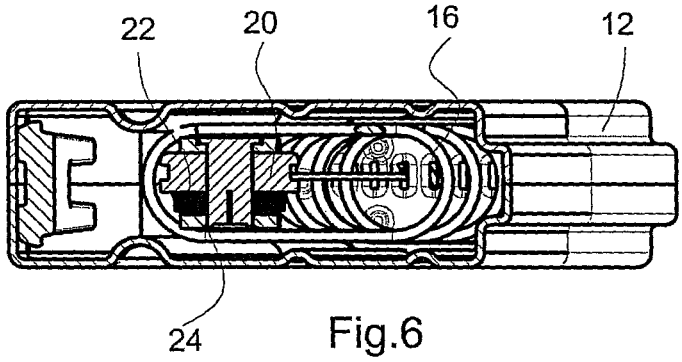
FIG. 6 is a sectional view taken along line A-A on FIG. 2.
Figure 7:
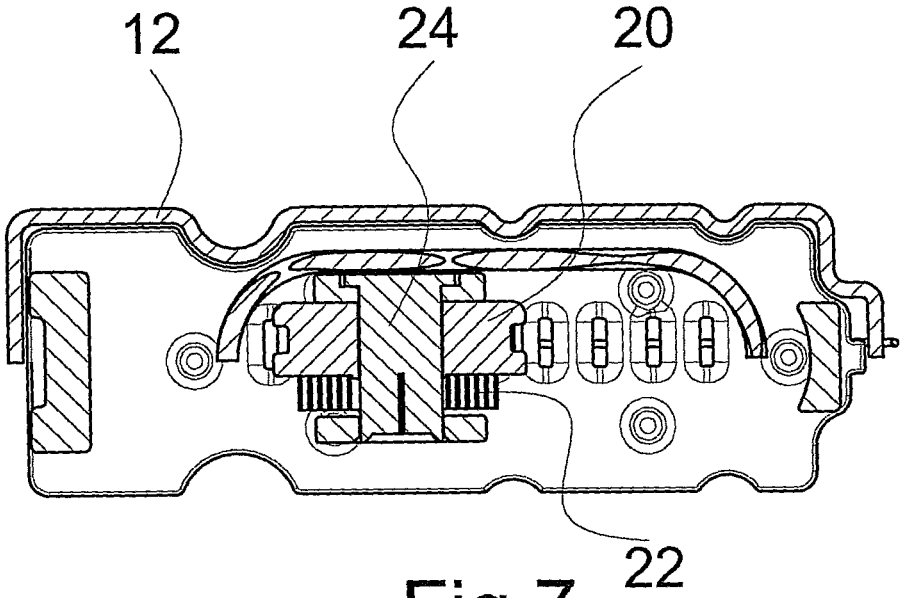
FIG. 7 is a sectional view taken along line B-B on FIG. 4.

Reel 20 defines an aperture 20*b* in its center. Axle 24 passes through aperture 20*b* and supports reel 20 while permitting rotation of the reel around the axle. Reel 20 is biased by a spiral torsion spring of metal ribbon 22, i.e., a mainspring. Mainspring 22 is mounted on reel 20. An upstanding flange 22*a* on mainspring 22 engages a protruding tooth 20*a* near the periphery of reel 20. This engagement can be seen most clearly in FIGS. 6 and 7, enlarged sectional views of the chain collecting mechanism. When mainspring 22 is mounted on reel 20, an aperture 22*b* in the center of mainspring 22 is in registration with aperture 20*b*. Axle 24 passes through apertures 22*b* and supports mainspring 22. Mainspring 22 also has an inwardly extending flange 22*d*, which engages a slit 24*d* in axle 24. In this way, flange 22*d* is retained in a fixed location in axle 24 when reel 20 rotates about axle 24, causing the mainspring 22 to expand, while contraction of mainspring 22 causes rotation in the opposite direction of reel 20.

Figure 8:
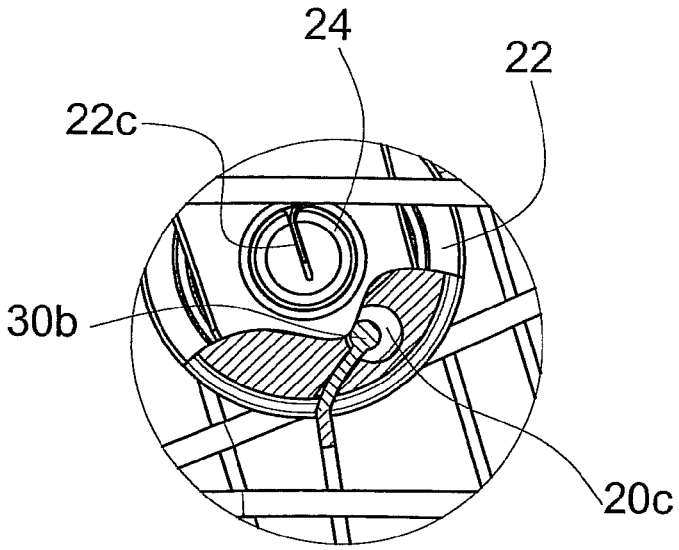
FIG. 8 is an enlarged sectional illustration of a retracting reel mechanism according to one embodiment of the invention.
Figure 9:
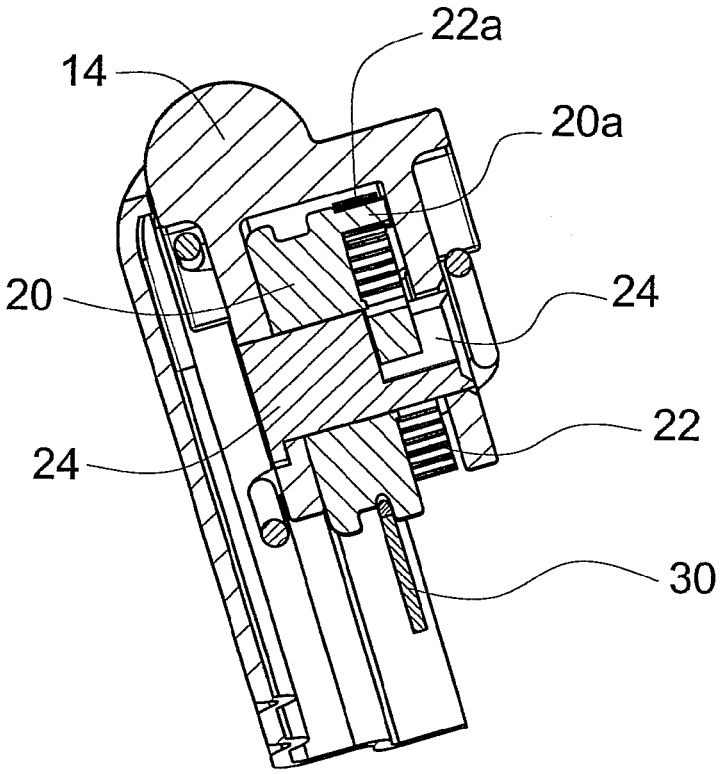
FIG. 9 is an enlarged sectional view taken along line C-C on FIG. 2.

One end 30*a* of chain 30 is coupled to reel 20. Reel 20 is configured to receive chain 30 wrapped around its circumference. As can be seen most clearly in FIG. 8, reel 20 defines an aperture 20*c* through which the first end 30*a* of chain 30 is introduced into reel 20. Chain 30 extends downwards through the magazine and through aperture 18*a* in the base of the magazine. A pull element 32 is mounted on the end 30*b* of chain 30 that extends from the magazine. Pull element 32 may be a handle or ring or bead or any other suitable element. Pulling the pull element 32 causes the reel to rotate, thereby releasing wrapped chain from around the reel and extending mainspring 22. When pull element 32 is released, mainspring 22 retracts and causes reel 20 to rotate in the opposite direction, thereby pulling any chain hanging outside the magazine into the magazine and wrapping the loose chain around the circumference of reel 20. Further understanding of the structure can be obtained by looking at FIGS. 6 and 8, respective sectional views taken through lines A-A and C-C on FIG. 2, and FIG. 7, a sectional view taken through lines B-B on FIG. 4.

The operation of magazine 10 will now be described with reference to FIGS. 2-5 with regard to loading a magazine. FIG. 2 is a cutaway illustration of the magazine of FIG. 1 in an empty, pre-loading orientation. As can be seen, magazine spring 16 is completely expanded within housing 12 and urges follower 14 towards lip 13 of the magazine 10. Mainspring 22 is rolled up on reel 20. Chain 30 is held taut inside magazine 10 with no excess chain hanging beyond the base 18 by pull ring 32 against base 18. Since ring 32 is larger than aperture 18*a*, it cannot fit though aperture 18*a* into the magazine. When it is desired to load cartridges into the magazine 10, ring 32 is pulled, e.g., by the hand or finger of a user.

Figure 3:
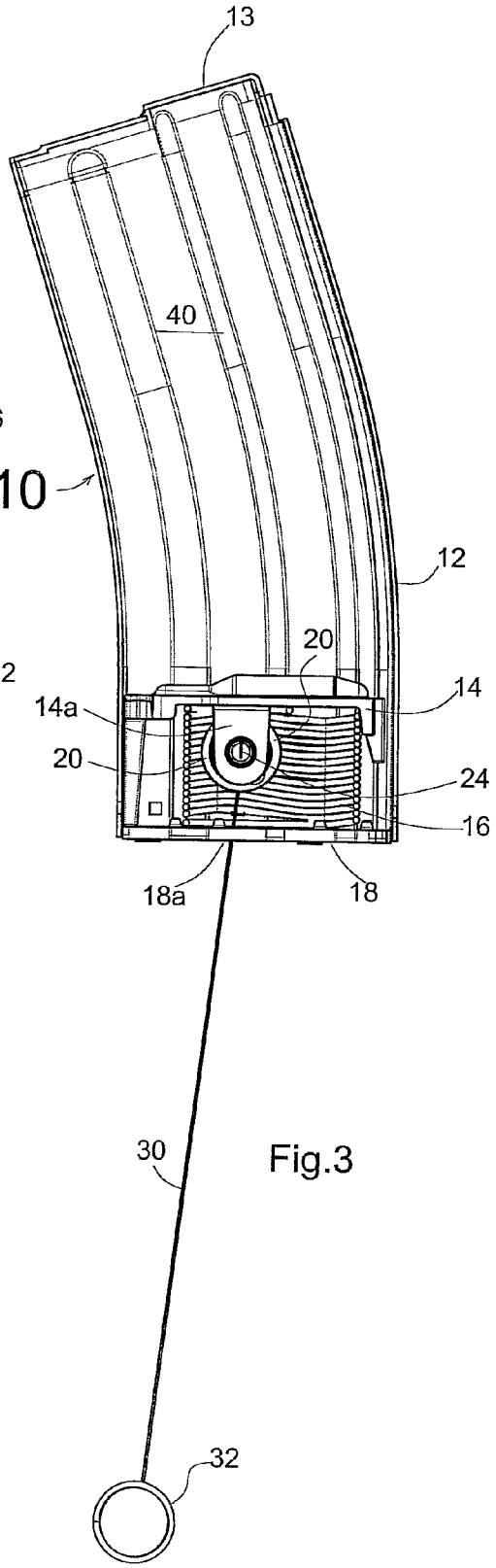
FIG. 3 is a partially cutaway illustration of the magazine of FIG. 1 in a substantially empty, pre-loading orientation, with the follower near the base and the pull chain outside of the magazine.

FIG. 3 is a partially cutaway illustration of the magazine 10 in a substantially empty, pre-loading orientation, after the ring 32 has been pulled but before any cartridges have been loaded. As can be seen, the pull chain 30 extends outside of the magazine, after pulling the follower 14 down near the base 18 against the action of the magazine spring 16.

It will be appreciated that, as chain 30 is pulled out through aperture 18*a*, reel 20 rotates, loading spring 22. When spring 22 is fully loaded, further pulling ring 32 causes the magazine follower 14 to move towards the base 18, compressing the magazine spring 16. Space 40 thus becomes available at the top of magazine 12 for introducing one or more cartridges 42. It will be appreciated that the illustration in FIG. 3 shows the magazine when the chain has been pulled all the way out, for easy loading of all the cartridges in the magazine. However, alternatively, the chain can be pulled only partially from the magazine, permitting easy insertion of a smaller number of cartridges at one time.

Figure 4:
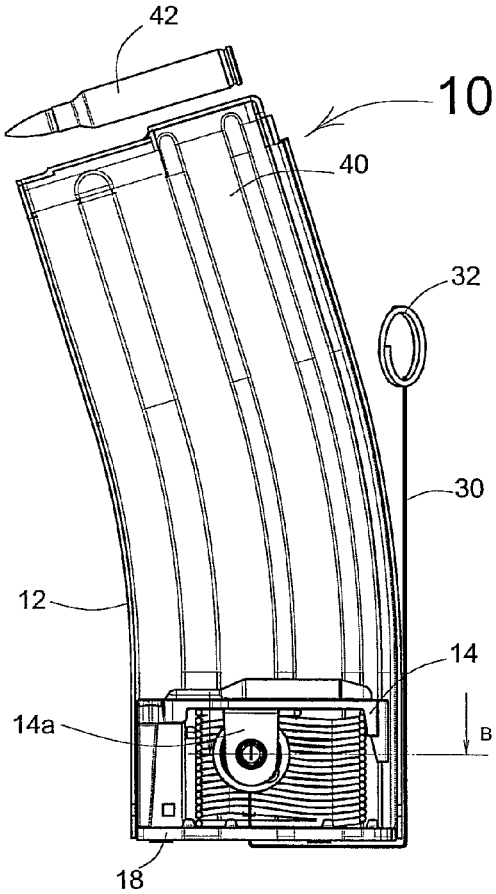
FIG. 4 is a sectional illustration of the magazine of FIG. 1 in a loading orientation, with the chain in a locked orientation.

FIG. 4 is a sectional illustration of the magazine 10 in a loading orientation, with the chain 30 in a locked orientation. In this embodiment, the chain is locked by pressure of the magazine housing 12 onto any surface (not shown) during loading. Alternatively, a mechanical locking mechanism (not shown) can be provided in base 18 whereby the chain is lockable at a desired location relative to the base, or the chain can be firmly held against the housing 12 using one hand, while the user loads the magazine with his other hand.

Figure 5:
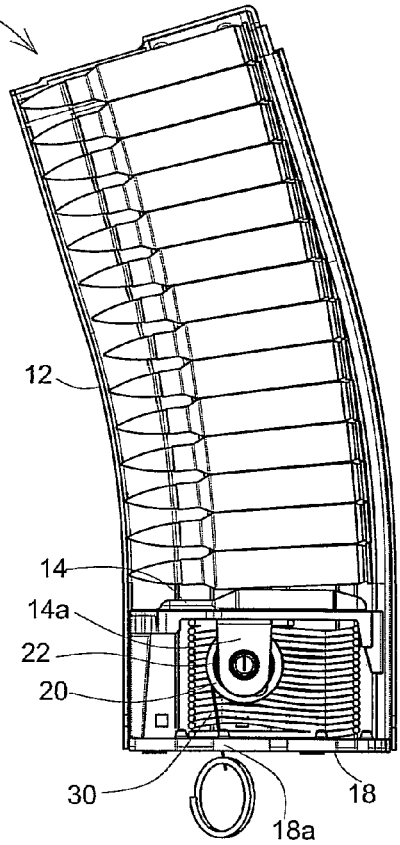
FIG. 5 is a sectional illustration of the magazine of FIG. 1 in a loaded orientation, after the chain has been retracted.

When the magazine has been filled with cartridges to the extent desired, the magazine spring 16 is still compressed, now by the cartridges in the magazine. Chain 30 is then released so that the loose chain 30 remaining outside the magazine can be collected. Releasing chain 30 permits the magazine spring 16 to expand and urge the follower 14 away from the base 18. This pushes the follower 14 and the loaded cartridges 42 towards the lips 13 of the magazine and secures the loaded cartridges inside the magazine. Releasing chain 30 also releases mainspring 22, which contracts and urges reel 20 to rotate in the opposite direction. Rotating reel 20 retracts the loose chain and causes it to wind around the axle of the reel 20. As a result, no loose chain 30 extends beyond base 18 and the chain inside housing 12 is held taut, so it cannot interfere with magazine spring 16, as seen in FIG. 5.

It will be appreciated that, when the top cartridge is released from the magazine, e.g., when the firearm is fired, magazine spring 16 further urges the follower 14 towards the lips 13 of the magazine. This causes reel 20 to rotate to release the necessary portion of chain 30 inside the magazine, still in a taut fashion.

It will be appreciated that a similar operation permits release of the pressure exerted on cartridges in the magazine, providing ease of unloading. When unloading the magazine 10, the user pulls the ring 32 to free a space at the top of the magazine. In some embodiments, the follower 14 can be releasably locked in place for unloading, as described above. Since the magazine spring 16 is no longer urging the cartridges against the lips of the magazine, the cartridges can easily be removed. For example, the user can turn the magazine upside down, with the mouth of the magazine towards the ground, and the cartridges will fall out of the magazine due to the force of gravity.

It is a particular feature of the invention that the magazine 10 is not substantially longer than a conventional magazine for an M16, and the ring extends only a short distance beneath the base, with substantially no loose chain extending beyond the base when the mainspring is at rest.

Furthermore, the invention can be implemented as a retrofit kit for existing magazines. The novel elements of the ammunition magazine can be packaged as a retrofit kit for a conventional ammunition magazine. Such a kit would include a replacement follower and a replacement base to replace the existing follower and base in the magazine. The replacement follower includes a chain coupled thereto for pulling the follower towards the base. Preferably, the chain is also coupled to a pull element, where the chain passes through an aperture in the replacement base and the pull element is disposed outside the ammunition magazine. The replacement follower also includes a mechanism coupled to the chain for retracting the chain when the follower has been pulled towards the replacement base. This mechanism may include a retracting reel mechanism having a mainspring, as described above, or may be any other suitable retraction mechanism.

It will be appreciated that chain of the invention can be formed of any suitable material, including a fabric or rope material, a metal chain, nylon, or any other sufficiently strong and flexible material.

In accordance with alternative embodiments of the present invention, the chain retraction mechanism includes a coiled spring with a chain affixed directly to a first end of the spring. According to this embodiment, the second end of the spring is affixed to and wound around an axle fixedly mounted between two depending lugs on the follower. Thus, the first end of the spring is coupled to the follower, and the chain is affixed directly to the second end of the spring. In this case, pulling a pull element, such as a ring or knob, coupled to the second end of the chain, releases wrapped chain from around the circumference of the spring and uncoils or extends the spring. When the pull element is released, the spring recoils, thereby retracting any chain hanging outside the magazine into the magazine and wrapping the loose chain around the circumference of spring.

The operation of such a magazine is substantially the same as that of magazine 10 of FIGS. 1 to 9. When it is desired to load and/or unload cartridges into the magazine, the pull element is pulled, e.g., by the hand or finger of a user. Releasing the chain also releases the spring, which recoils and retracts the loose chain and causes it to wind around the spring. As a result, no loose chain extends beyond the base of the magazine and the chain inside the magazine housing is held taut, so it cannot interfere with the magazine spring.

While the invention has been described herein above with regard to magazines for rifles, it will be appreciated that adaptations can be made for pistol magazines, which are also within the scope of the present invention.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. An ammunition magazine comprising:
- a housing having a base;
- a follower in said housing spring-biased against said base;
- a chain coupled to the follower for pulling said follower towards said base; and
- a mechanism mounted on the follower; and
- said chain being coupled to said mechanism;
- wherein said mechanism is configured to collect a loose portion of said chain after said follower has been pulled towards said base,
- wherein said mechanism includes a retracting reel mechanism having a mainspring, one end of said chain being coupled to said reel.

2. The ammunition magazine as claimed in claim 1, wherein a second end of said chain is coupled to a pull element, where the chain passes through an aperture in the base and the pull element is disposed outside the ammunition magazine.

3. The ammunition magazine as claimed in claim 2, further comprising a mechanical locking mechanism in the base for locking the chain at a desired location relative to the base.

4. An ammunition magazine comprising:
- a housing having a base;
- a follower in said housing spring-biased against said base;
- a chain coupled to the follower for pulling said follower towards said base; and
- a mechanism mounted on the follower; and
- said chain being coupled to said mechanism;
- wherein said mechanism is configured to collect a loose portion of said chain after said follower has been pulled towards said base,
- wherein said mechanism includes a coiled spring, wherein a first end of said coiled spring is affixed to said follower, and one end of said chain is coupled to a second end of said coiled spring.

5. A retrofit kit for a conventional ammunition magazine having a housing with a base and a follower in the housing spring-biased against the base, the kit comprising:
- a replacement follower for the magazine; and
- a replacement base for the magazine;
- the replacement follower including a chain coupled thereto for pulling the follower towards the base, and
- a mechanism mounted on the follower, said chain being coupled to said mechanism;

wherein said mechanism is configured to collect a loose portion of said chain after said follower has been pulled towards said base, wherein said mechanism includes a retracting reel mechanism having a mainspring, one end of said chain being coupled to said reel.

6. A retrofit kit for a conventional ammunition magazine having a housing with a base and a follower in the housing spring-biased against the base, the kit comprising:

a replacement follower for the magazine; and a replacement base for the magazine;

the replacement follower including a chain coupled thereto for pulling the follower towards the base, and a mechanism mounted on the follower, said chain being coupled to said mechanism;

wherein said mechanism is configured to collect a loose portion of said chain after said follower has been pulled towards said base, wherein said mechanism includes a coiled spring, one end of which is affixed to said follower, one end of said chain being coupled to a second end of said coiled spring.

7. The kit as claimed in claim 5, wherein a second end of said chain is coupled to a pull element, where the chain passes through an aperture in the replacement base and the pull element is disposed outside the ammunition magazine.

8. The kit as claimed in claim 7 further comprising a mechanical locking mechanism in the base for locking the chain at a desired location relative to the base.

9. The magazine as claimed in claim 4, wherein a second end of said chain is coupled to a pull element, where the chain passes through an aperture in the replacement base and the pull element is disposed outside the ammunition magazine.

10. The magazine as claimed in claim 9, further comprising a mechanical locking mechanism in the base for locking the chain at a desired location relative to the base.

11. The kit as claimed in claim 6, wherein a second end of said chain is coupled to a pull element, where the chain passes through an aperture in the replacement base and the pull element is disposed outside the ammunition magazine.

12. The kit as claimed in claim 9, further comprising a mechanical locking mechanism in the base for locking the chain at a desired location relative to the base.

* * * * *